US006089158A

United States Patent [19]

Barroso

[11] Patent Number: 6,089,158

[45] Date of Patent: Jul. 18, 2000

[54] PRINTING PRESS WITH DELIVERY INCLUDING INDEPENDENTLY MOUNTED SPROCKETS

[76] Inventor: Earl N. Barroso, 921 Oxford St., Houston, Tex. 77008

[21] Appl. No.: 09/404,687

[22] Filed: Sep. 24, 1999

[51] Int. Cl.[7] ..... B65H 29/04

[52] U.S. Cl. ..... 101/232; 101/419; 101/408; 271/204

[58] Field of Search ..... 271/204, 205; 101/232, 118, 419, 420, 408

[56] References Cited

U.S. PATENT DOCUMENTS

| | | | |
|---|---|---|---|
| 2,747,870 | 5/1956 | Backhouse | 271/207 |
| 4,085,930 | 4/1978 | Weisgerber et al. | 271/204 |
| 4,643,414 | 2/1987 | Weisgerber | 271/183 |
| 4,766,810 | 8/1988 | Alt | 101/217 |
| 5,088,404 | 2/1992 | MacConnell et al. | 101/232 |
| 5,431,386 | 7/1995 | Blaser | 271/204 |

*Primary Examiner*—John S. Hilten
*Assistant Examiner*—Daniel J. Colilla
*Attorney, Agent, or Firm*—Bill B. Berryhill

[57] ABSTRACT

A chain delivery assembly for withdrawing sheets from a rotating cylinder of a sheet-fed offset printing press includes first and second spaced apart sprockets independently mounted for rotation about a common axis which is parallel to the axis of the rotating cylinder, first and second gears being coaxially affixed adjacent to the first and second sprockets, respectively. A pair of chains, carried by the sprockets, have grippers for engaging leading edges of sheets to carry them away from the cylinder. A rotatable shaft, mounted away from the chains and whose axis is parallel to the axis of the rotating cylinder has third and fourth gears affixed to opposite ends thereof. The first gear is operatively connected to the third gear for rotation of the rotatable shaft and the fourth gear. The fourth gear is operatively connected to the second gear to drive the second sprocket in coordinated rotation with the first sprocket.

4 Claims, 3 Drawing Sheets

PRINTING PRESS WITH DELIVERY INCLUDING INDEPENDENTLY MOUNTED SPROCKETS

BACKGROUND OF THE INVENTION

1. Field of the Invention

The present invention pertains to sheet-fed, offset printing presses. In particular, the present invention pertains to an improved chain delivery assembly for an offset printing press which prevents contact of ink wet sheets with mechanisms of the delivery system.

2. Description of the Prior Art

In sheet-fed, offset printing presses, a sheet of paper is drawn between an ink coated blanket cylinder and an impression cylinder. An image is transferred to the paper sheets in the form of wet ink. It is necessary that the wet ink, freshly printed sheet be supported and guided during transfer of the sheet from the impression cylinder to a delivery station or another printing station for further printing thereon. This is accomplished, in most printing presses, by a delivery system which includes a chain conveyor carrying one or more gripper assemblies having sheet grippers which grip and pull the sheet from the impression cylinder.

The typical chain delivery system includes a pair of sprockets mounted on opposite ends of a shaft for rotation about an axis which is parallel to the axis of the impression cylinder. A chain extends around each of the sprockets and has horizontal upper and lower runs. The sheet grippers of the gripping assemblies carried by the chains grip the leading edge of each sheet after it passes through the impression cylinder.

A long-standing problem associated with offset printing presses of the prior art is avoiding contact of the wet ink on the sheets with the shaft which extends between the two sprockets. Any contact of the shaft with the ink will likely cause smearing. Most systems attempt to avoid such problems by placing small wheels, sometimes referred to as "star wheels" or "skeleton wheels", on the shaft to hold the sheets away from the shaft. The wheels are preferably positioned to contact the sheet of paper where no ink is deposited. This is not always possible, particularly in sheets with extensive amount of ink coverage.

A number of mechanisms have been proposed for eliminating the problem of smearing of ink by the shaft which extends between the two sprockets of the chain delivery assembly or by the star wheels or skeleton wheels mounted on the shaft. In U.S. Pat. No. 4,665,823 the chain delivery system is provided with hollow cylinder support bars of resilient, rigid plastic material which has triboelectric charge directing properties resistive to printing ink and printing ink solvents. These bars are supposed to prevent contact of the ink wet sheet with the sprocket shafts.

In U.S. Pat. No. 4,722,276, a horizontal tube is mounted adjacent to and parallel to the axis of the shaft connecting the sprockets. The tube is provided with circular openings through to which air is discharged against the sheets of paper preventing them from contacting the shaft.

In U.S. Pat. No. 4,977,828, a frame assembly is coupled to the sprocket shaft which is provided with elongated cylindrical rollers which are mounted for free rotation about axes extending parallel to the sprocket shaft for engagement with the wetted side of the sheet during transportation. The rollers are covered with a fabric impregnated with a liquid repellent substance and are supposed to reduce smearing.

SUMMARY OF THE PRESENT INVENTION

In the present invention, the usual shaft which normally coaxially connects the sprockets of a chain delivery system is eliminated. Gears, existing with a first of the sprockets, remain affixed to that sprocket of the chain delivery system. Another shaft is normally mounted below the chains of the delivery system and has an axis which is parallel to the axis of the sprockets. A gear is affixed to one end of this shaft. This gear engages gears associated with the above mentioned first sprocket to be driven thereby. In a preferred embodiment of the invention, another gear is attached to the opposite end of this shaft and through a new gear arrangement engages a new gear affixed to the second sprocket to drive the second sprocket in coordinated rotation with the first sprocket. Thus, both sprockets and the chains associated therewith are driven simultaneously without the shaft normally provided between sprockets of prior art printing presses. This completely eliminates contact of ink wet sheets with the connecting sprocket shaft since the shaft no longer exists. Other features and advantages of the present invention will be apparent from the description which follows in conjunction with the accompanying drawings.

DESCRIPTION OF A PREFERRED EMBODIMENT

Figure 1:
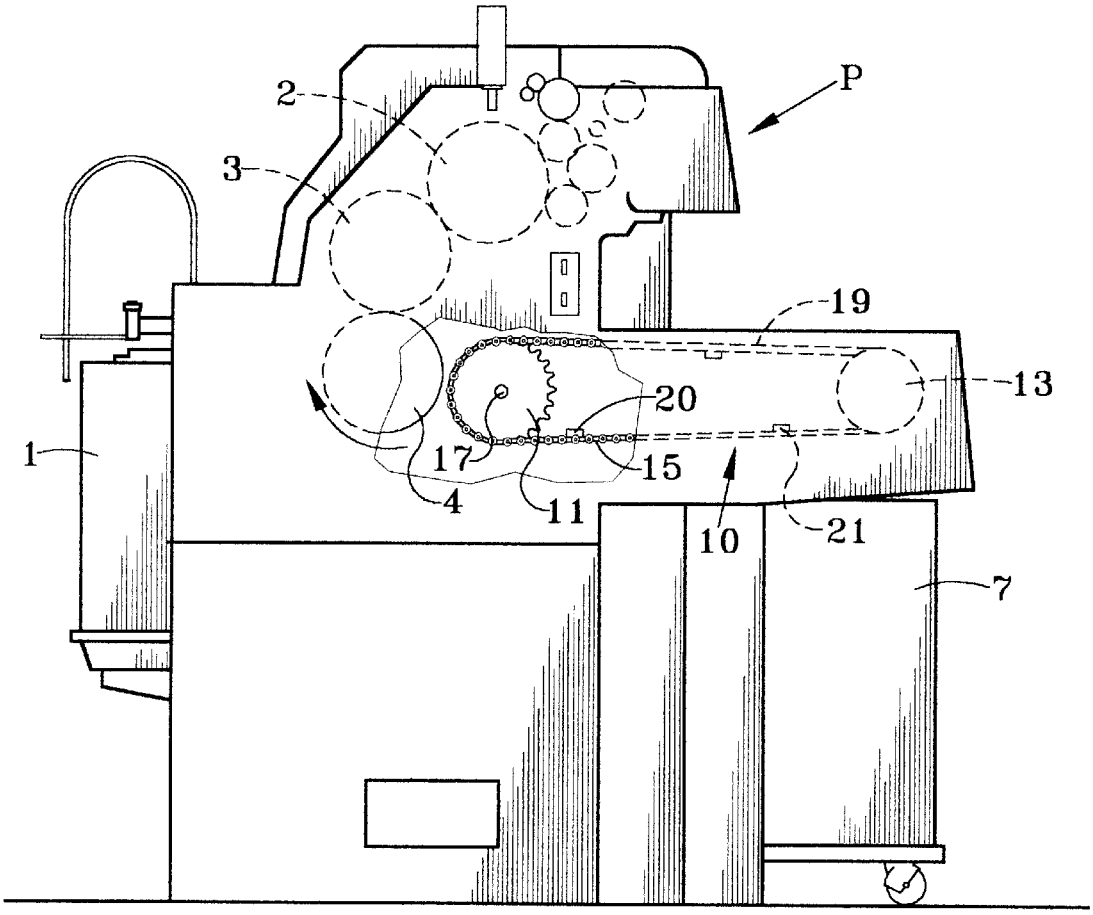
FIG. 1 (PRIOR ART)
FIG. 1 is a side view, partially in section, of a sheet-fed, offset printing press illustrating the press and prior art systems for transferring sheets of printed paper therein.
Figure 2:
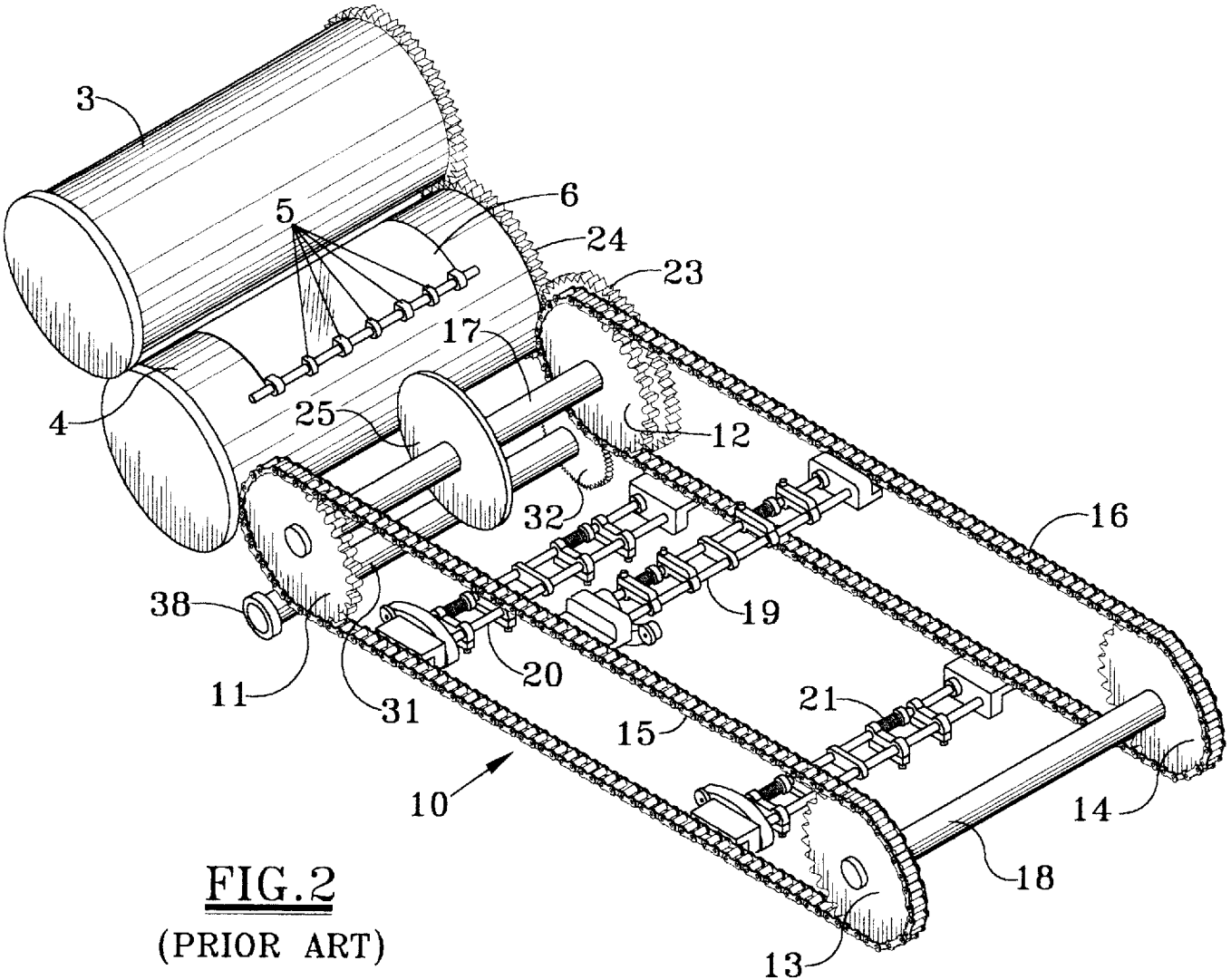
FIG. 2 (PRIOR ART)
FIG. 2 is an enlarged partial perspective view of the printing press of FIG. 1 illustrating a typical prior art chain delivery assembly.

Referring first to FIGS. 1 and 2, there is illustrated a sheet-fed, offset printing press P typical of the prior art. The press includes a sheet feeder station 1 in which individual sheets of paper are stacked and sequentially fed into the printing station of the press. The printing station includes a plate cylinder 2, a blanket cylinder 3 and an impression cylinder 4. The impression cylinder 4 is provided with sheet grippers 5 (see FIG. 2) for gripping and holding the sheets of paper 6 during movement through the printing station. A delivery system 10 functions to pull freshly printed sheets of paper from the impression cylinder 4 to convey the printed sheets to either another printing station or to a delivery station 7 where the printed sheets are stacked for removal from the press P.

As best seen in FIG. 2, the delivery system or assembly 10 comprises two pair of chain sprockets 11, 12 and 13, 14 for carrying a pair of chains 15, 16. Sprockets 11 and 12 are coaxially mounted on the opposite ends of a shaft 17 and sprockets 13 and 14 are coaxially mounted on opposite ends of a shaft 18. The upper runs of the chains 15 and 16 lead toward the impression cylinder 4 and the lower runs of chains 15 and 16 lead away from the cylinder 4. Sheet gripper assemblies 19, 20, 21 are carried by the chains 15, 16 for engaging leading edges of sheets on the impression cylinder 4 to carry them away from the impression cylinder 4. The sheet grippers of each assembly 19, 20, 21 are opened and closed in response to cam mechanisms which exist and are not claimed as part of the present invention. Another shaft 31, which is parallel to the axis of shaft 17, is normally mounted and supported below the chains 15 and 16. Shaft 31 operates other mechanisms. One end of the shaft 31 is provided with a gear 32 which engages gears (not shown) associated with sprocket 12 and a coaxial gear 27 and which rotate therewith. Thus, rotation of sprocket 12 results in rotation of shaft 31. The opposite end of the shaft is supported in a bearing of some type as represented at 38.

Coaxially mounted and affixed to the sprocket 12 is a gear 23 which engages a gear 24 on the end of the impression cylinder 4 which is turn engaged by other gears of a power train being driven by a source of power (not shown). The power train drives the gears 24, 23 which, in turn, rotates the sprocket 12 and through the shaft 17 drives the sprocket 11 so that both sprockets 11 and 12 rotate simultaneously. This causes the chains 15 and 16 to move simultaneously so that the sheet gripping assemblies 19, 20 and 21 move in coordinated relationship therewith.

In systems of the prior art, sheets which are pulled from the impression cylinder 4 by the delivery system or assembly 10 sometime contact the shaft 17 connecting the sprockets 11 and 12. Such contact with the shaft 17 would likely cause smearing of the wet ink on the sheets being delivered by the delivery system 10. To help solve this situation, many printing presses of the prior art, such as the one illustrated in FIGS. 1 and 2, provide a star wheel or skeleton wheel 25 which is attached to the shaft 17, rotating therewith and with the sprockets 11 and 12. These wheels 25 are preferably positioned to contact the sheet of paper where no ink is deposited. This is not always possible, particularly in sheets with extensive amounts of ink coverage. For this reason, other solutions, such as those mentioned in the above description of the prior art have been proposed.

Figure 3:
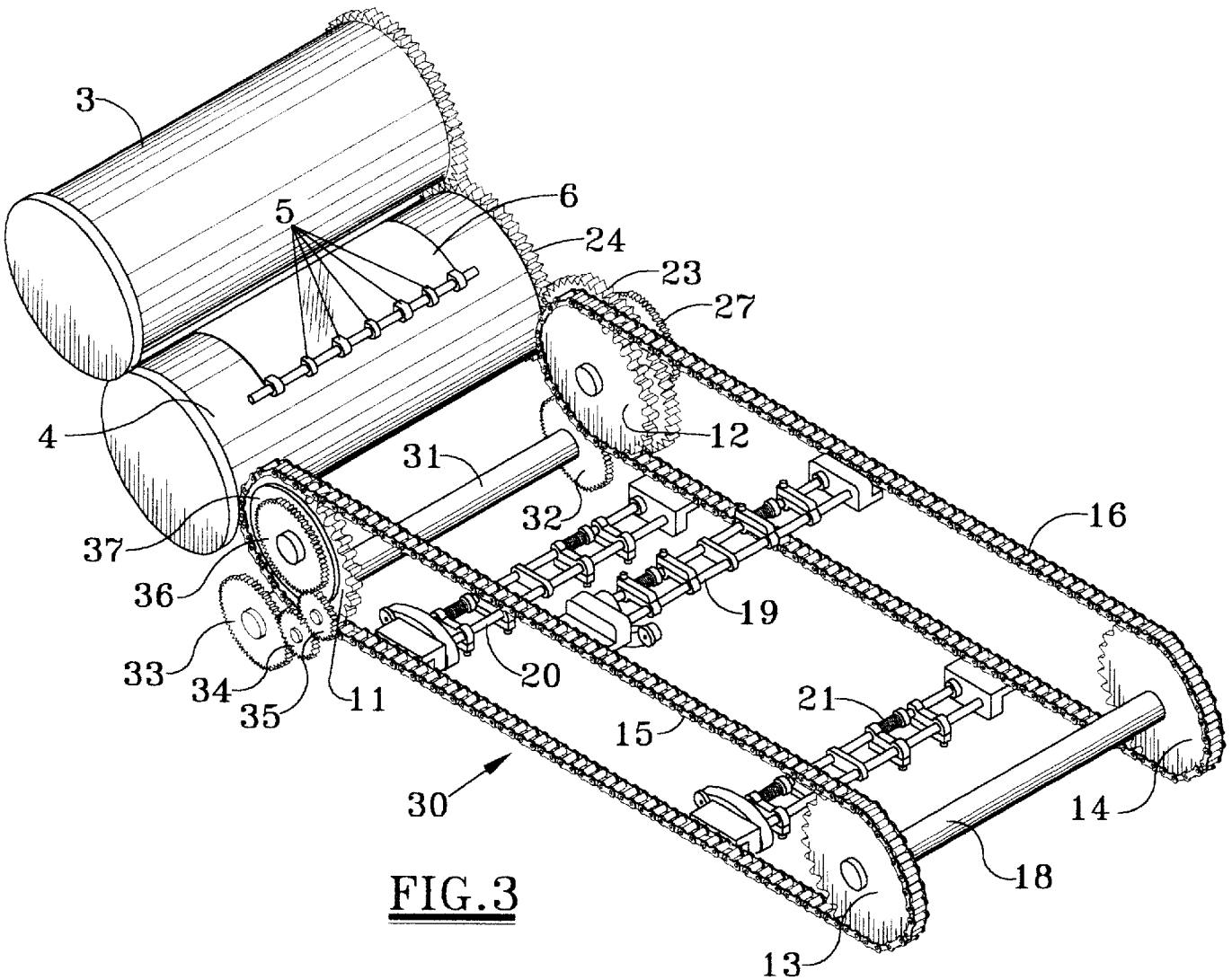
FIG. 3 is a partial perspective view of a printing press utilizing the improved chain delivery assembly of the present invention.

The present invention, as shown in FIG. 3, eliminates the star wheel or skeleton wheel 25 of the prior art and in fact, eliminates the shaft 17 which normally would coaxially connect the sprockets 11 and 12. Thus, the problem of contact of wet ink on sheets with the shaft 15 completely eliminated. This is accomplished with a delivery system 30 which in many respects is the same as the delivery system 10 of FIG. 2 utilizing many of the same parts. Identical parts are referenced with numbers in FIG. 3 which correspond with the numbers in FIG. 2.

Like in the delivery system 10 of FIG. 2, the delivery system 30 of the present invention provides two pairs of sprockets 11, 12 and 13, 14 and corresponding chains 15 and 16. Sheet gripping assemblies 19, 20 and 21 are attached to the chains 15 and 16. The chains 15 and 16 carry the gripping assemblies 19, 20, 21 to the impression cylinder 4 for gripping leading edges of sheets thereon and then for carrying them away from the cylinder for stacking or to a different printing station. The gripping assemblies 19, 20, 21 are operated by cams (not shown). This operation is essentially the same as in the prior art illustrated in FIG. 2.

The major difference between the chain delivery assembly 30 of the present invention and the prior art is the removal of the shaft 17 and wheel 25. As in the prior art and in the present invention, as shown in the embodiment of FIG. 3, the shaft 31 rotatingly mounted below the chains 15 and 16, has an axis parallel to the rotating cylinder 4. A gear 32 is affixed to one end. However, in the present invention, an additional gear 33 is fixed to the opposite end of the shaft 31. The gear 33 engages other gears 34, 35, 36. The gear 36 is affixed to sprocket 11 and may be separated therefrom by a spacer 37. The additional gears 33, 34, 35 and 36 are essentially mirror images of gear 32, two other gears (not shown) corresponding with gears 34, 35 and gear 27 (which corresponds with gear 36). Rotation of the gears 23 and 27 by the existing drive train rotates the shaft 31 which, in turn, rotates gear 33. Gear 33 engages gears 34, 35, 36. As previously stated, gear 36 is attached to sprocket 11 so that sprocket 11 is driven in coordinated rotation with sprocket 12. Sprockets 11 and 12, rotating simultaneously, drive chains 15 and 16 as required.

With the chain delivery of the present invention, the usual shaft which coaxially connects sprockets 11 and 12 is eliminated, preventing contact with sheets therewith and rendering unnecessary all of the previous solutions such as those mentioned in description of the prior art. The delivery system of the present invention is relatively simple and lends itself to retro-fitting of existing sheet-fed offset printing presses. However, new machines may be manufactured from the beginning with the delivery system shown in FIG. 3. The same principals of operation will apply to small presses costing several thousand dollars and to large presses costing more than a million dollars.

Although a single embodiment of the invention has been described herein, many variations thereof will be apparent to those skilled in the art without departing from the spirit of the invention. Accordingly, it is intended that the scope of the invention be limited only by the claims which follow.

What is claimed is:

1. A sheet-fed offset printing press having a chain delivery assembly for withdrawing sheets from a rotating cylinder, said chain delivery system comprising:

first and second spaced apart sprockets independently mounted for rotation about a common axis which is parallel to the axis of said rotating cylinder;

first and second gears coaxially affixed adjacent to said first and second sprockets, respectively;

first and second chains carried by said first and second sprockets, respectively, each having an upper run leading toward said cylinder and a lower run leading away from said cylinder;

gripping means carried by said chains for engaging leading edges of said sheets to carry them away from said cylinder;

a rotatable shaft whose axis is parallel to the axis of said rotating cylinder mounted away from said chains and having third and fourth gears affixed to opposite ends thereof; and power means operatively connected to said first sprocket for rotation of said first sprocket and said first gear, said first gear being operatively connected to said third gear for rotation of said rotatable shaft and said fourth gear at the opposite end thereof, said fourth gear being operatively connected to said second gear to drive said second sprocket in coordinated rotation with said first sprocket.

2. The sheet-fed offset printing press of claim 1 in which said first gear is operatively connected to said third gear by one or more other gears.

3. The sheet-fed offset printing press of claim 1 in which said fourth gear is operatively connected to said second gear by one or more other gears.

4. The sheet-fed offset printing press of claim 1 retro-fitted from a previously manufactured press in which said first and second sprockets are mounted on a common intervening sprocket shaft, said sprocket shaft being removed in said retro-fitted press leaving open space between said first and second sprockets, said first and third gears existing on said previously manufactured press, said third gear being attached to one end of another shaft which becomes said shaft at the opposite end of which is affixed said fourth gear, said second gear being affixed to said second sprocket so that said second sprocket may then be driven in coordination with said first sprocket without said intervening shaft.

* * * * *